United States Patent [19]

McGuire et al.

[11] Patent Number: 4,644,598

[45] Date of Patent: Feb. 24, 1987

[54] FITTED COMFORTER FOR INFANT

[76] Inventors: Douglas R. McGuire, 199D McCulloch Blvd., Suite 275; Sherry L. McGuire, 2961 Tonto Dr., both of Lake Havasu City, Ariz. 86403; Ellen A. Rohrich, 1719 Cody Ave., Casper, Wyo. 82604

[21] Appl. No.: 636,731

[22] Filed: Aug. 1, 1984

[51] Int. Cl.[4] ..... A47G 9/02

[52] U.S. Cl. ..... 5/497; 5/424; 5/502

[58] Field of Search ..... 5/494, 495, 496, 497, 5/482, 500, 502, 424

[56] References Cited

U.S. PATENT DOCUMENTS 2,569,627 10/1951 Black .
2,695,414 11/1954 Ford et al. .
2,942,280 6/1960 May ..... 5/497
2,994,094 8/1961 Hester .
3,111,688 11/1963 Barnes .
3,467,974 9/1969 Deutsch .
3,906,559 9/1975 Bahr ..... 5/496

FOREIGN PATENT DOCUMENTS 891355 3/1962 United Kingdom ..... 5/496

*Primary Examiner*—Alexander Grosz
*Attorney, Agent, or Firm*—Emmette R. Holman

[57] ABSTRACT

In an infant-safe comforter fitted to the foot end of a crib mattress, the grasping power of the two boxed corners of the comforter on the corners of the mattress is controllably reduced by limiting the extent of an elasticized central segment of the free edge between the two corner seams in the foot end of the comforter. The terminal points of this elasticized central portion are spaced $1\frac{1}{2}$ inches inboard from each of the corner seams. The nudging head of an infant crawling under the comforter to the foot end raises the free edge above the bottom perimeter bead of the mattress to admit access of air under the comforter and releases the grasp at the corners to prevent asphyxiation under a comforter of low air permeability.

2 Claims, 9 Drawing Figures

FITTED COMFORTER FOR INFANT

BACKGROUND OF THE INVENTION

This invention relates to an infant comforter that is fitted at the foot end to a crib mattress by boxing the two corners at the foot end. When the full length of the free edge at the foot end of the comforter is elasticized, as in the hypothetical Hester/Deutsch combination which is discussed in detail later in this specification, it is drawn under the corners of the mattress to which it is fitted. By this means the foot end of the mattress is secured from slippage. Its removal from the mattress requires a vigorous tug far in excess of any force that an infant is capable of exerting. Normally, a strong tug with one hand assisted by a coordinated peeling action with the fingers of the other hand of an adult is required so as to minimize the possibility of tearing the fabric by tugging alone.

The Hester/Deutsch comforter, strongly anchored to the foot end of the crib mattress with its free edge tightly tucked under the mattress presents an asphyxiation hazard for an infant who crawls head first under the comforter to the foot end. It does, however, reduce the hazard of asphyxiation by entanglement of the head of the infant in a loose comforter.

It is an object of this invention to provide security against the hazard of entanglement in a loose comforter as well as security against the hazard of asphyxiation at the foot end of the tightly fitted comforter which has limited air permeability.

This objective is achieved by an improvement of the hypothetical Hester/Deutsch combination comforter, having a free edge extending from a first seam in a first boxed corner to a second seam in a second boxed corner, wherein only a limited central segment of the free edge is elasticized. This limited central segment terminates $1\frac{1}{2}$ inches $\pm\frac{1}{2}$ inch inboard of each of the first and second seams.

DETAILED DESCRIPTION AND DISCUSSION

Figure 1:
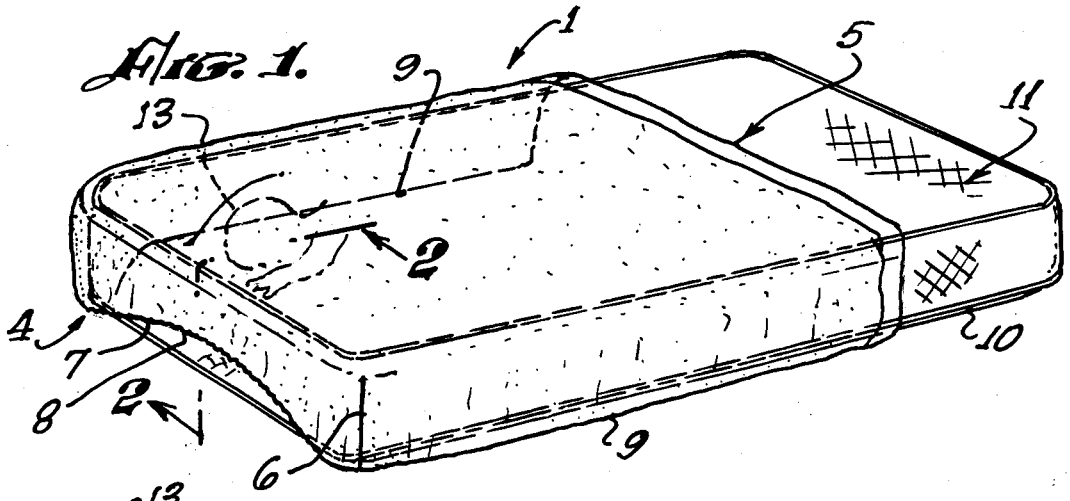
FIG. 1 is a view in perspective from the top showing a crib mattress with the comforter according to the invention engaged with the foot end of the mattress and showing the head of an infant nudging the free edge of the comforter upward.
Figure 2:
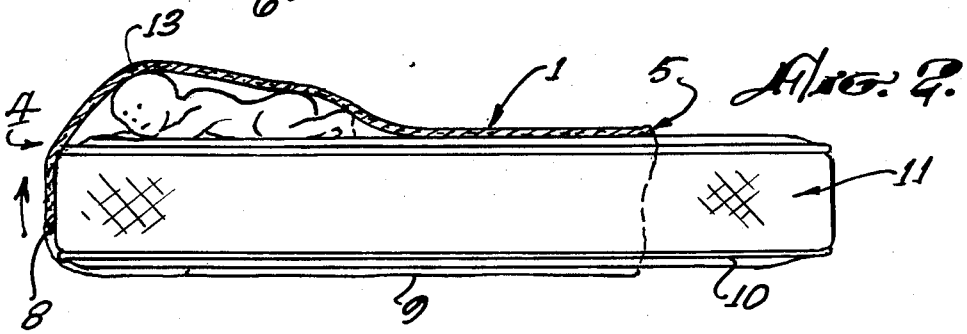
FIG. 2 is a sectional side view as seen through line 2—2 of FIG. 1.
Figure 3:
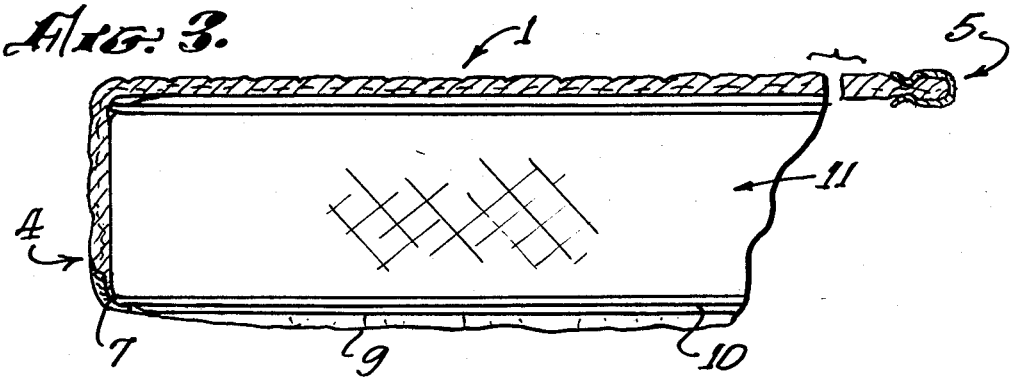
FIG. 3 is a partial sectional side view similar to FIG. 2 without the infant.
Figure 4:
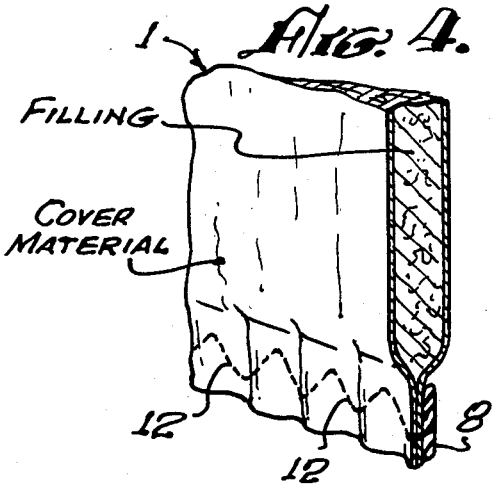
FIG. 4 is a view in perspective of a partial section through the elasticized central segment of the free edge of the comforter at the foot end, much enlarged to show the zig-zag stitching.
Figure 5:
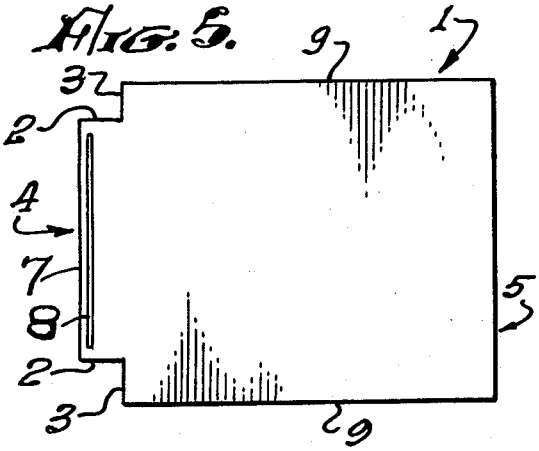
FIG. 5 is a plan view of the blank from which the comforter is sewn, showing at the foot end the cut-away corner squares and the central elasticized segment of the free edge.

The comforter, generally indicated as (1), is produced from a rectangular blank best seen in FIG. 5. It has a foot end, generally indicated as (4), and a head end (5). A 7 inch square is cut out of each corner at the foot end 4 creating paired cut edges indicated as (2) and (3) in each corner square. The paired edges 2 and 3 are sewn together along a seam designated as (6) to close each of the boxed corners. The free edge (7) at the foot end 4 of the comforter extends the full distance between a first seam 6 to a second seam 6. A stretched strip of elastic tape (8) is sewn, using zig-zag stitches (12), to a limited central segment of free edge 7, so that the resulting elastic segment terminates $1\frac{1}{2}$ inches $\pm\frac{1}{2}$ inch inboard of each seam 6. The side free edges (9), which extend from seam 6 to head end 5, are not elasticized. They may be tucked under the bottom perimeter bead (10) of the mattress, generally indicated as (11), or they may be left to drape, as shown in FIGS. 1, 2 and 3, over the side of the mattress.

As a restless infant crawls about under the comforter and works its way head first to the foot end 4, it can readily be seen that, somewhere along the way, the free edge of the comforter at the head end 5 will drop down on the mattress and effectively seal off the free access of air from head end 5 as the feet of the infant draw away from it. The closer the head (13) of the infant gets to the foot end 4 the greater the hazard of asphyxiation under a comforter of low air permeability. As shown in FIGS. 1 and 2, the nudging head 13 first raises the central elasticized segment 8 of the free edge above the bottom perimeter end bead (15) at the foot end 4 with which bead it engages in an air sealing contact, to gradually open a channel for free access of air, whereby asphyxiation is avoided.

Actual asphyxiation of the infant depends on several factors that contribute to the availability of fresh air under the comforter: (a) the size of the air pocket surrounding the infant's body, (b) the effectiveness of the air seal between the elasticized tape 8 and mattress bead 15 taken as the most vulnerable segment of the peripheral air seal of the comforter lying flat on the mattress and (c) the air permeability of the comforter construction and material. If the effectiveness of air seal (b) is too low, or the air permeability is too high, the comforter will fail to provide adequate warmth. In the opposite extreme case the relative humidity of the air under the comforter climbs to an uncomfortable 100% and the fabric is wet from the condensation of water in the interior of the insulation. To be commercially useful the comforter must strike a compromise of the advantages and disadvantages somewhere between these extremes. In the worst case there is a hazard of asphyxiation or, having survived that threat, a hazard of anoxia brain damage from partial deprivation of oxygen. The term "asphyxiation" as used for the purposes of this invention is intended to to include this qualification of the term.

The comforter, normally in place, grasps the side walls of the mattress, adjacent to the corners, with a tension that pulls the corner seam 6 with short segments of its adjacent free ends 7 and 9 around and under the bottom perimeter beads 15 and 10, respectively, of the mattress, with a scooping action in each corner, as seen in FIGS. 6 to 9. The tension is caused by the stretched strip of elastic tape (8). The tensile force exerted in this manner manifests itself in the value of length L, which is the distance from the point (16), where free edge 9 crosses over bottom perimeter side bead 10, to an extension (14) of the bottom perimeter end bead 15 at the foot end of the mattress. The value of L increases as the tensile force increases. A second manifestation of the tensile force is the angle $\alpha$ of inclination of the seam 6 with the bottom perimeter end bead 15. The value of angle $\alpha$ decreases as the tensile force increases, and $\alpha=45°$ when the tensile force$=0$.

Figure 6:
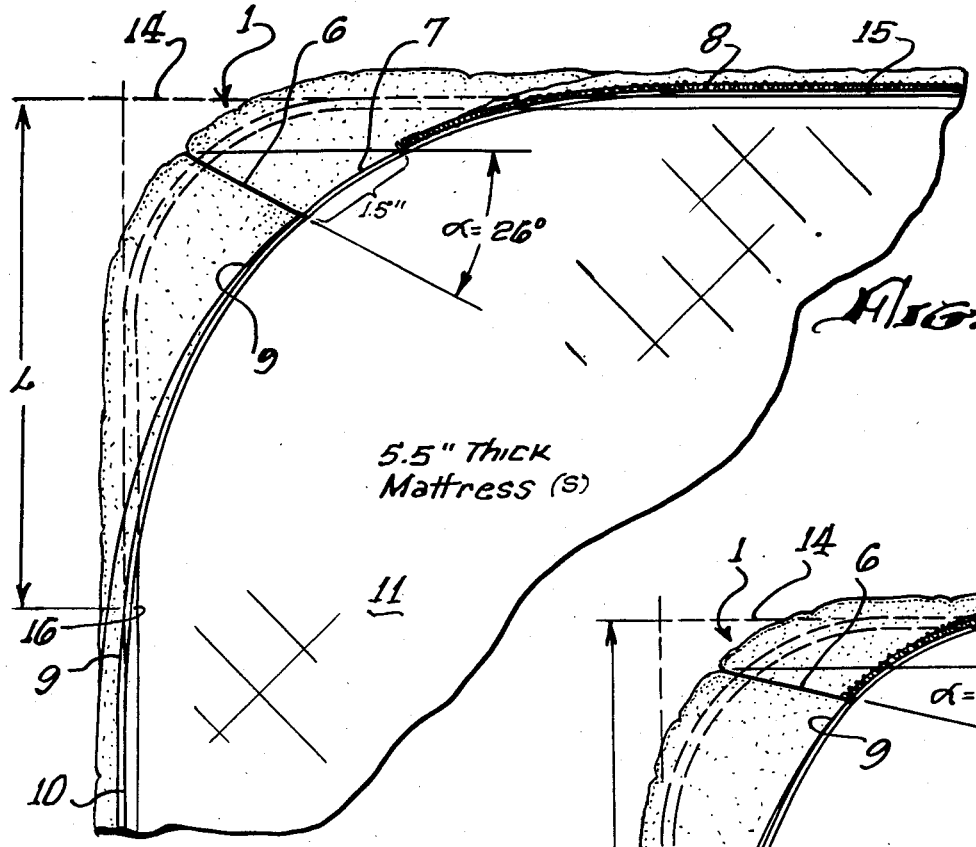
FIG. 6 is a fragmentary bottom view of one corner of the crib mattress, showing in detail how the free edge of the comforter, which is elasticized only in a central segment spaced $1\frac{1}{2}$ inches from the corner seam according to the invention, reaches around and under the bottom perimeter bead of a $5\frac{1}{2}$ inch thick mattress.
Figure 7:
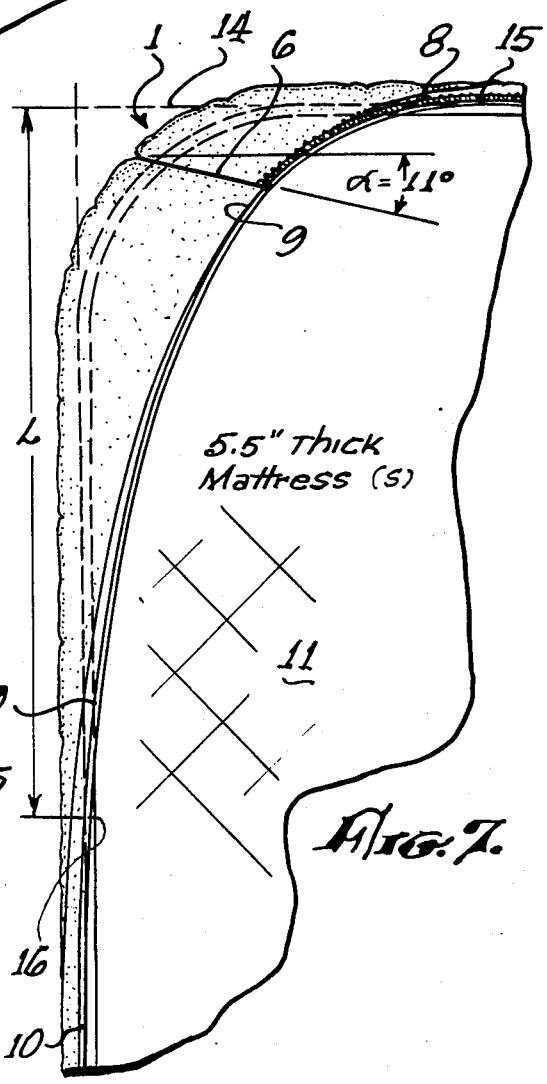
FIG. 7 is a fragmentary bottom view similar to FIG. 6 except that the comforter is elasticized from corner seam to corner seam according to the hypothetical Hester/Deutsch combination, which is not according to the invention, on a $5\frac{1}{2}$ inch thick mattress.
Figure 8:
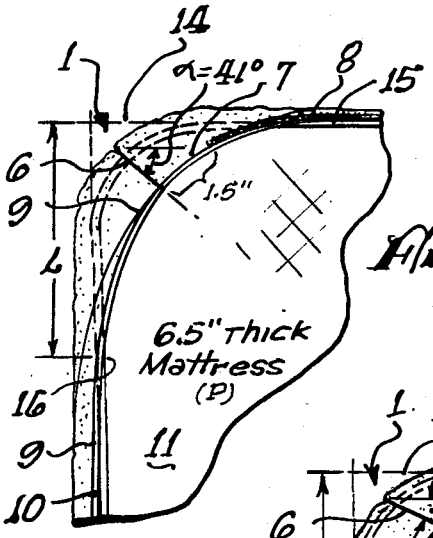
FIG. 8 is a fragmentary bottom view of the same comforter of FIG. 6, according to the invention, except on a $6\frac{1}{2}$ inch thick mattress.
Figure 9:
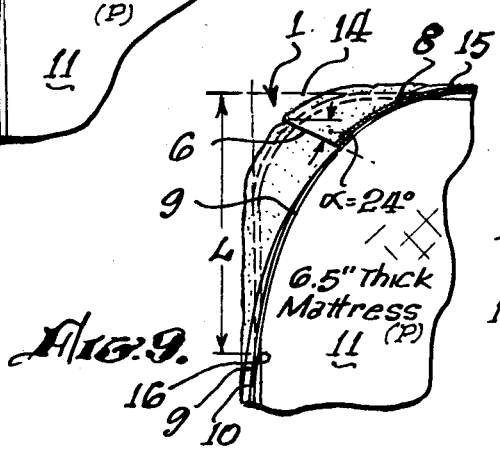
FIG. 9 is a fragmentary bottom view of the same comforter of FIG. 7 on a $6\frac{1}{2}$ inch thick mattress.

A series of experiments were run using comforter A, which is constructed according to the invention with the elasticized central segment 8 of the free edge 7 terminated $1\frac{1}{2}$ inches inboard of seam 6, as shown in FIGS. 6 and 8; and also using the hypothetical Hester/Deutsch combination comforter B, which is elasticized over the entire length of free edge 7, from corner seam to corner seam, as shown in FIGS. 7 and 9, but is otherwise of identical construction to comforter A. These two comforters were alternately engaged in combinations with a standard quality crib mattress (S), measuring $27\frac{1}{2}''\times52''\times5\frac{1}{2}''$ and with a premium quality crib mattress (P), measuring $27\frac{1}{2}''\times52''\times6\frac{1}{2}''$. The combination AS is shown in FIG. 6, BS in FIG. 7, AP in FIG. 8 and BP in FIG. 9. Each test combination was photographed with identical geometry, capturing the image of both boxed corners in the same picture; each combination was run in duplicate. The measurements of L and $\alpha$ were taken from the photographs, so each reported value is the average of 4 actual measurements. The values of L were measured in arbitrary decimal units. The values of $\alpha$ were computed by trigonometry from triangulation reference points. The results are reported in the following contingency table:

| | MATTRESS | | |
|---|---|---|---|
| | $\alpha°/L$ | S | P |
| COMFORTER | A | 26/7.0 | 41/6.5 |
| | B | 11/10.8 | 24/7.6 |

It is evident in the table that the values of $\alpha$ are smaller with B than with A in both the S column and in the P column, reflecting the fact that the tensile force is greater with B than with A. The value of L is greater with B than with A comforter in both S and P columns, again reflecting the higher tensile force of B versus A.

It is obvious that the magnitude of the tensile force is greater for the P mattress than for the S mattress simply because the same comforter must stretch farther to engage the deeper P mattress. However, the grasp on either mattress of comforter A of the present invention is substantially weaker than that of the hypothetical Hester/Deutsch combination comforter B. With respect to the upthrust from beneath the comforter required to disengage comforter A in a simulation of the feeble upthrust of the head of an infant thereunder, the disengagement force is, surprisingly, about the same on either mattress and not too difficult for an infant. With hypothetical Hester/Deutsch comforter B the required upthrust is too difficult for a child when in combination with the S mattress and in combination with the P mattress, it is inconveniently difficult for an adult servicing the crib.

The precise mechanism of the disengagement process of the herein-disclosed comforter is not completely understood. However, it has been observed that the initiation of disengagement commences with the arcuate elevation of the central elasticized segment 8 above and out of sealing contact with the bottom perimeter end bead 15; the elevation of 8 being first, and highest, under the point of applied upthrust and gradually spreading toward the corners. As the upthrust continues, the tucked-under portion of the free edge 7 immediately adjacent to seam 6 disengages from bottom perimeter end bead 15, at which point the corner of the comforter snaps loose.

We have ascertained that the placement of the limited elasticized segment 8 at the center of the free edge 7 is uniquely effective. Surprisingly, when the elasticized segment is shifted to one side, or when the elasticized segment is subdivided and its subdivisions are distributed along the length of the free edge 7, the effectiveness is substantially lost. Also the length of the elasticized segment 8 is critical. When the length is altered so that the terminal point is spaced outside of the limits of $1\frac{1}{2}$ inches $\pm\frac{1}{2}$ inch from nearest corner seam 6, the effectiveness is totally unacceptable. The restriction of this spacing to $1\frac{1}{2}\pm\frac{1}{2}$ inches expresses the widest tolerable range; a range of $1\frac{1}{2}\pm\frac{1}{4}$ inches is the preferred range, while a spacing of $1\frac{1}{2}$ inches is the best mode of practice of the invention.

This indicates that the elasticized segment 8 is very critical as to its central placement on free edge 7 and that it is also very critical as to its spacing from the corner seams 6. We have no logical explanation for these criticalities. We are not aware of any prior art use of these criticalities. They are the very essence of this invention.

We are aware of U.S. Pat. No. 3,467,974 issued to I. Deutsch on Sept. 23, 1969, which teaches a comforter with two squares cut out of the foot end corners, as in the present invention, but the resulting cut edges are not sewn together; they are provided instead with snaps, zippers, or tie strings, for securing tightly to the corners of the mattress. The free edge is not elasticized at the footend. The foot end drapes over the mattress and extends vertically down past the thickness of the mattress plus the thickness of the bedspring box so as to conceal both. The free edge does not reach around and tuck under the bottom perimeter edge of the mattress at the foot end corners as occurs in the present invention. It grasps too tightly to the mattress for the purpose of this invention.

We are aware of U.S. Pat. No. 2,695,414 issued to J. A. Ford, et al, on Nov. 30, 1954, which teaches a custom-tailored top bedsheet which is fitted to the foot end of the mattress and is tucked thereunder. Extra fabric at the foot end drapes over the foot end of the mattress to provide a non-binding pocket to accommodate the feet of a tall person. The free edge is not elasticized. This construction is designed to prevent the free access of air at the foot end.

We are aware of U.S. Pat. No. 3,111,688 issued to A. F. Barnes on Nov. 26, 1963, which teaches a bottom bedsheet fitted to a mattress. The free edge of the bed sheet is elasticized in only one of its four boxed corners.

This construction is too tight for use in the present invention.

We are aware of U.S. Pat. No. 2,994,094 issued to H. G. Hester on Aug. 1, 1961, which teaches a bottom bedsheet which is fitted to a mattress wherein two of its four free edges are elasticized, corner to corner, at the head- and foot-ends. Additional triangular reinforcing plates are provided, but, with or without these plates this construction is too tight for use in the present invention.

We are also aware of U.S. Pat. No. 2,569,627 issued to M. B. Black on Oct. 2, 1951, which teaches a bottom bedsheet fitted to a mattress, wherein all four of its free edges are elasticized over their entire corner to corner lengths. This construction is also too tight for use in the present invention.

The reference previously made herein to the "hypothetical Hester/Deutsch" combination comforter reflects the fact that such a combination is not known to us to have been used or commercially offered on the market and also the fact that it combines the most closely relevant elements of the Hester and the Deutsch patents to the comforter of this invention. Even the best combination of Hester and Deutsch results in a comforter with foot end corners unclosed by sewing but, for the purposes of this disclosure this deficiency was neglected and it was consistently assumed throughout that the corners were sewn closed.

SUMMARY AND CONCLUSION

The infant-safe comforter disclosed herein has two boxed corners at the foot end, each of which corner is closed by a sewed corner seam. The free edge of the comforter is elasticized at the foot end. These features appear in the closest prior art known to us which is a hypothetical result from taking the fitted bedsheet of Hester in U.S. Pat. No. 2,994,094 in combination with the fitted comforter of Deutsch in U.S. Pat. No. 3,467,974. This hypothetical comforter provides two boxed corners which, however, are left unclosed by sewing. Moreover, the following essential elements of this invention are absent in the hypothetical Hester/-Deutsch comforter:

(a) only a limited segment of the free edge is elasticized;

(b) the limited elasticized segment is centered on the free edge; and (c) the length of the limited central elasticized segment is the distance between the two points spaced $1\frac{1}{2}\pm\frac{1}{2}$ inches inboard from each of the two corner seams at the foot end.

We claim:

1. In an infant-safe comforter fitted to the foot end of a crib mattress, which comforter has first and second boxed corners adapted to reach under corresponding first and second bottom perimeter corners at the foot end of the mattress, the improvement consisting of providing a limited central elasticized segment of the free edge at the foot end of said comforter, said free edge extending from a first seam in said first boxed corner to a second seam in said second boxed corner, said limited central elasticized segment of said free edge extending from a first point spaced about 1 to 2 inches inboard from said first seam in said first boxed corner to a second point spaced about 1 to 2 inches inboard from said second seam in said second boxed corner of said comforter, whereby the grasping power of said first and second boxed corners of said comforter on said crib mattress is reduced to an extent that the nudging head of an infant crawling under said comforter toward said foot end releases the grasp of said comforter on said crib mattress and raises said comforter free edge to admit access of air under the comforter and thereby prevent asphyxiation of the infant.

2. An infant-safe comforter according to claim 1, wherein said first point is spaced about $1\frac{1}{2}$ inches inboard from said first seam in said first boxed corner and said second point is spaced about $1\frac{1}{2}$ inches inboard from said second seam in said second boxed corner of said comforter.

* * * * *